United States Patent [19]

DiPalma

[11] 4,070,083

[45] Jan. 24, 1978

[54] ELECTRICAL POWER LINE EXTENSION

[76] Inventor: Joseph DiPalma, 98 North Ave., Westport, Conn. 06880

[21] Appl. No.: 763,922

[22] Filed: Jan. 31, 1977

[51] Int. Cl.[2] ..... H01R 13/58

[52] U.S. Cl. ..... 339/104; 174/65 R; 339/101

[58] Field of Search ..... 174/90, 65 R; 339/104, 339/101, 103 R, 107, 89 R

[56] References Cited

U.S. PATENT DOCUMENTS

| | | | |
|---|---|---|---|
| 2,143,985 | 1/1939 | Kellems | 339/101 X |
| 3,535,674 | 10/1970 | Hansen | 339/107 |
| 3,603,913 | 9/1971 | Hasty, Jr. | 339/104 |

*Primary Examiner*—Joseph H. McGlynn
*Assistant Examiner*—DeWalden W. Jones
*Attorney, Agent, or Firm*—Arthur A. Johnson

[57] ABSTRACT

There is disclosed herein an electrical extension cable unit in which the portion of the flexible cable extending from the plug is surrounded by strain-relieving means comprising a contractible sleeve of stiff interlaced wires, the ends of which are clamped to the plug, said wires being sufficiently stiff to resist sharp bending of the cable adjacent its connection to the plug. In the event of the socket for the plug being connected to a flexible power-carrying cable, the latter is also surrounded by a like strain-relieving, sharp bending resistant sleeve secured to the receptacle for the plug.

7 Claims, 4 Drawing Figures

ELECTRICAL POWER LINE EXTENSION

This invention relates to improvements in flexible electrical power line extensions and more particularly to means for relieving the pulling strain on the ends of the conducting wires on the fitting to which they are connected and for resisting sharp bending of the flexible cable conducting the wires where it projects from the fitting to which it is attached.

Strains on the ends of conducting wires applied in pulling a plug having contact blades out of a receptacle to receive the blades can be substantially relieved by forming a knot on the wires which lies in a cavity in the plug and which will not pass through the wire passage of the plug. However, in cases where there is no space for such a knot or the wires themselves are not suitable for knotting, there seems to be no simple way heretofore proposed for solving the problem.

The danger of wires breaking in receptacles and plugs which are not locked together in operative position is somewhat mitigated by the fact that excessive pulling strains on the cable can result in the plug being pulled from the receptacle. However, where the plug and receptacle are locked together against separation, pulling strains could cause the live wires in either the plug or the receptacle to be broken and crossed which may cause a fire or other substantial damage.

In using attachment plugs there is also the problem of breaking the wires and/or the insulation of the cable caused by frequent sharp bending of the latter where it emerges from the plug or receptacle for a plug.

It is an object of this invention to avoid both these problems in a simple and efficacious manner.

This is accomplished by employing a contractible sleeve of stiff, anguarly interlaced wires surrounding and snugly fitting the cable as it enters and/or leaves a fitting and fixedly connecting the adjacent end of the sleeve to the appropriate part of the fitting, the wire being sufficiently stiff to resist sharp bending of the cable. Providing the cable connected to the receptacle with a strain-relieving and bend-resisting sleeve of the present invention causes any force applied to the cable to be absorbed by the sleeve rather than by the ends of the cable for the wires therein.

Other features and advantages will hereinafter appear.

Figure 1:
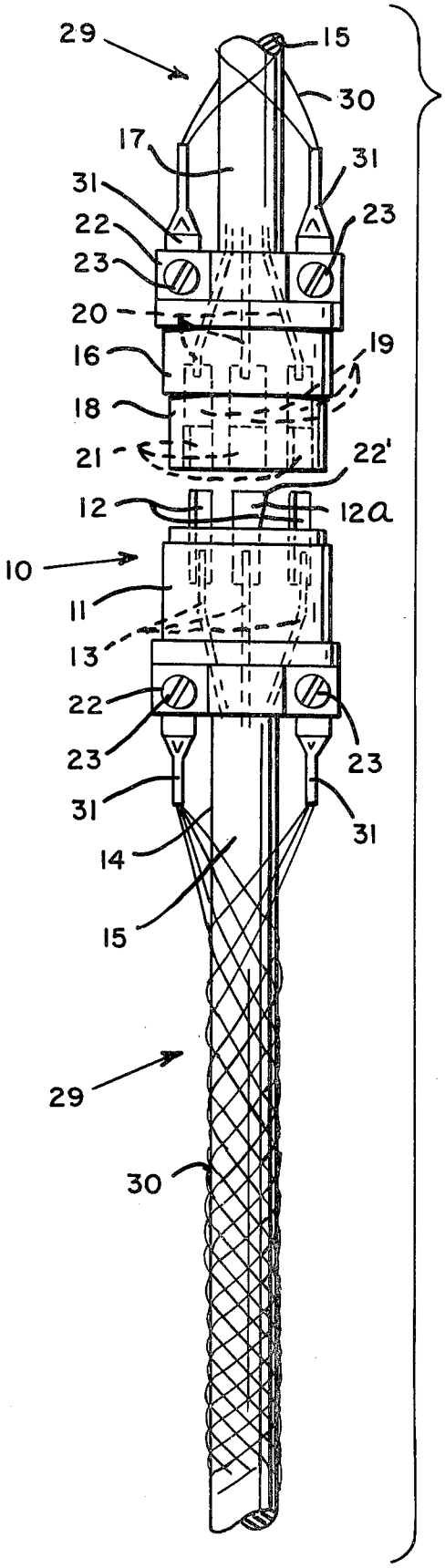
FIG. 1 is a side elevation of a plug receptacle attached to a flexible cable showing the ends of a strain-relieving, bend-resisting woven wire sheath secured to the receptacle, and separated from the receptacle.

As shown in the accompanying drawings, the attachment plug 10 has a body 11 of insulating material having therein and projecting therefrom contact blades 12 to which the bared ends of wires 13 are soldered or otherwise attached. The wires 13 are carried in a cable 14 of insulating material. Heavy duty cables also have a sheath 15 of tough insulating material.

Figure 2:
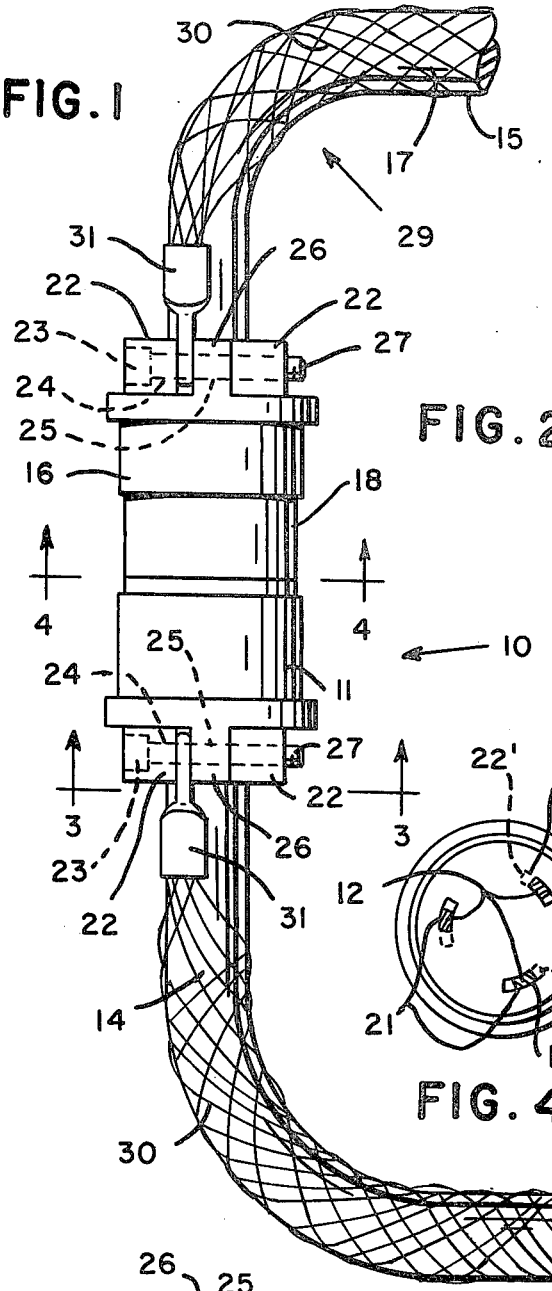
FIG. 2 is a similar view of the plug and receptacle assembled.
Figure 4:
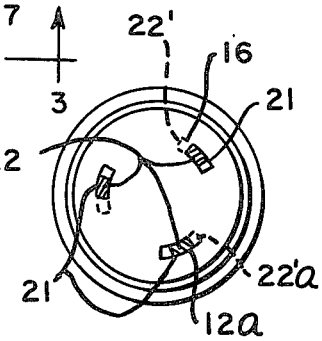
FIG. 4 is a transverse section of the receptacle taken on the line 4—4 of FIG. 2 showing the slots for receiving the contact blades.

Some attachment plugs may be used in receptacles permanently fixed to some stationary supporting structure; others, as illustrated in FIGS. 1 and 2, may be used with a receptacle 16 carried by and connected to a cable 17 which also has a sheath 15 of tough insulating material.

The receptacle 16 has a body 18 having mounted therein a plurality of contacts 19 connected to bared ends of wires 20 in the cable 17 and positioned to be engaged by the blades 12 of the plug 10 when the latter and the receptacle are aligned and forced together, the blades 12 passing through slots 21 in the receptacle body.

In the form of the invention illustrated herein, the plug 10 and the receptacle 16 are so made that they can be interlocked in engaged position. In the broader aspects of the invention any suitable interlock may be employed. However, in the form of the invention illustrated the blades 12 are flat and the slots 21 in the receptacle are rectangular and transversely long enough to permit the plug to be rotated on the axis of the receptacle. At least one of the blades 12 (blade **12*a*) has an overhanging portion 22' which engages the end of its slot 21 and prevents its withdrawal from its slot until the slot and blade realign. The blade 12*a* will only fit in its corresponding slot 21*a*, thereby serving to maintain the phase or polarity relationship of the wires 13 in the plug and the wires 20** in the receptacle.

As stated above, one of the objects of the present invention is to avoid excessive pulling force being applied to the cables from separating or breaking the wire ends from their respective contacts. Such separation or breakage, besides being annoying, might result in causing a short circuit by the broken wires touching each other and might result in causing a fire.

To avoid such breaks the present invention provides two clamping jaws 22 on the plug and two like clamping jaws 22 on the receptacle to apply pressure to the sheath 15 of the cable distorting it sufficiently to hold the cable against movement relative to the plug or receptacle to which it is attached.

Figure 3:
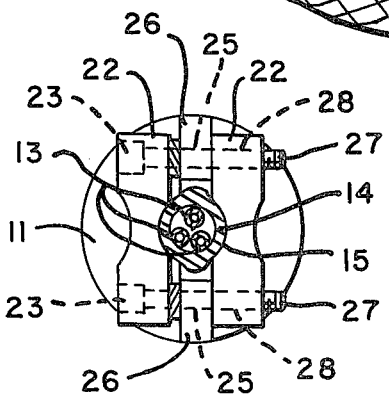
FIG. 3 is a transverse section taken on the line 3—3 of FIG. 2 showing the clamps for securing the cable to the plug.

Referring to FIG. 3 which is illustrative of the clamp for the plug for instance, the clamp for the receptacle being the same, the clamping jaws 22 are mounted on a pair of screws 23 extending through holes 24 in one of the jaws, through holes 25 in lugs 26 projecting from the body of the plug and having screw threads 27 passing through screw-threaded holes 28 in the other jaw. When the screws 23 are tightened, the jaws 22 are brought together deforming the engaged portion of the sheath sufficiently to secure the cable firmly to the plug.

As stated above, another object of this invention is to provide improved means for resisting the sharp arcuate bending of the cable which would damage the cable and may dangerously expose live wires, and, by the same means, facilitating the operation of pulling the plug from the receptacle without applying pulling force directly to the cable and the wires therein.

For this purpose the cable 14 is provided with a stiff wire sheath 29 which is sufficiently stiff and extends far enough from the plug 10 to resist any force tending to make a sharp bend in the cable.

To resist any pulling force applied to the cable from being transmitted to the ends of the wires 13, the sheath 29 is made of a plurality of stiff metal wires 30, the strands of which are diagonally interwoven with the opposite ends of the wires being provided with lugs 31 which are respectively secured to jaw-supporting lugs 26 on the body of the plug.

The sheath 29 is woven to have a diameter slightly less than that of the cable so that after it is applied to the end of the cable it will contract and frictionally engage the surface of the cable with the result that any pulling strain on the cable or the sheath will cause the latter to contract and more firmly engage the cable and transfer the force applied to the plug.

What has been said about the sheath 29 and the clamping jaws 22 in reference to the plug 10 applies to the receptacle 16 when, as shown, the latter is attached to a cable.

It should also be noted that the pulling force applied to the cable may be intentional. However, the force may be accidentally applied.

Variations and modifications may be made within the scope of the claims and portions of the improvements may be used without others.

I claim:

1. An electrical power line extension comprising an attachment plug having a body of insulating material having on one end a plurality of projecting contact prongs; a cable comprising a flexible cover containing a plurality of insulated wires selectively connected to said projecting contact prongs; clamping means on the body for securing said cable against axial removal from said body, the portion of the cable extending from said clamping means being bendable arcuately with relation to the axis of the body; and strain relieving means comprising a contractible sleeve of stiff interlaced wires surrounding said cable and at one end being secured to said clamping means, said sleeve being long enough and sufficiently stiff considering the bendability of cable to resist sharp bending of the cable adjacent its connection to said clamping means, the ends of the interlaced wires being gathered in two groups and there is a lug secured to the end of each of said groups of wires for attachment to said body.

2. An electrical power line extension according to claim 1 in which said body has a pair of projecting ears and said clamping means has a pair of jaws, one on each side of said ears, and screw means extending through said jaws and through said ears for tightening said jaws on said cable and securing the lugs to the body.

3. An electrical power line extension comprising an attachment plug having a body of insulating material having on one end a plurality of projecting contact prongs; a cable comprising a flexible cover containing a plurality of insulated wires selectively connected to said projecting contact prongs; clamping means on the body for securing said cable against axial removal from said body, the portion of the cable extending from said clamping means being bendable arcuately with relation to the axis of the body; strain relieving means comprising a contractible sleeve of stiff interlaced wires surrounding said cable and at one end being secured to said clamping means, said sleeve being long enough and sufficiently stiff considering the bendability of the cable to resist sharp bending of the cable adjacent its connection to said clamping means, said attachment plug being one element of a coupling between said cable and a second cable, the second element of the coupling having a body of insulating material having internal contact sockets to receive and electrically engage said contact prongs on said attachment plug, said second cable having a plurality of insulated wires selectively connected to said contact sockets; clamping means on the body of said second element for securing said second cable against axial removal from said body of said second element; and strain relieving means comprising a second contractible sleeve of stiff interlaced wires surrounding said second cable and at one end being secured to said clamping means, said sleeve being long enough and sufficiently stiff considering the bendability of the cable to resist sharp bending of the cable adjacent its connection to said clamping means.

4. An electrical power line extension according to claim 3 in which the ends of said last-named interlaced wires are gathered in two groups and there is a lug secured to the end of each of said groups of wires for attachment to said second body.

5. An electrical power line extension according to claim 4 in which said second body has a pair of projecting ears and said clamping means on said second body has a pair of jaws, one on each side of said ears, and screw means extending through said last-named jaws and through said lugs for tightening said jaws on said cable and securing the lugs to the body.

6. An electrical power line extension according to claim 1 in which said contractible sleeve has a unstressed circumference sufficiently smaller than the diameter of said flexible cover to frictionally engage the cable cover and contract and tighten on the cover in response to application of a pulling force to the cable.

7. An electrical power line extension according to claim 3 in which said contractible sleeve has an unstressed circumference sufficiently smaller than the diameter of said flexible cover to frictionally engage the cable cover and contract and tighten on the cover in response to application of a pulling force to the cable.

* * * * *